US005852279A

United States Patent [19]

Mak et al.

[11] Patent Number: 5,852,279

[45] Date of Patent: Dec. 22, 1998

[54] CLOTHES IRON WITH AUTOMATIC SHUT OFF SYSTEM CONTROLLED BY MULTIPLE SWITCHES

[75] Inventors: Chi Kin Mak, Wan Chai; Ka Hong Wo, Lei King Wan; Wai Man Yeung, Kowloon, all of Hong Kong

[73] Assignee: Windmere Corporation, Miami Lakes, Fla.

[21] Appl. No.: 725,677

[22] Filed: Oct. 2, 1996

[51] Int. Cl.[6] ..... D06F 75/00

[52] U.S. Cl. ..... 219/257; 38/82

[58] Field of Search ..... 219/257, 256, 219/250, 245; 38/74, 82

[56] References Cited

U.S. PATENT DOCUMENTS

| | | | |
|---|---|---|---|
| 1,284,104 | 11/1918 | Heylman | 219/257 |
| 2,150,029 | 3/1939 | French | 219/257 |
| 2,382,587 | 8/1945 | Thomas . | |
| 2,470,532 | 5/1949 | Thomas . | |
| 3,424,894 | 1/1969 | Schwartz et al. . | |
| 3,492,459 | 1/1970 | Schwartz . | |
| 4,130,955 | 12/1978 | Baumgartner et al. . | |
| 4,203,101 | 5/1980 | Towsend . | |
| 4,366,366 | 12/1982 | Ekblad . | |
| 4,520,257 | 5/1985 | Schwob et al. . | |
| 4,577,424 | 3/1986 | Liu . | |
| 4,661,685 | 4/1987 | Contri . | |
| 4,673,798 | 6/1987 | Contri et al. . | |
| 4,686,352 | 8/1987 | Nawrot et al. . | |
| 4,692,589 | 9/1987 | Borsari et al. . | |
| 4,727,240 | 2/1988 | Provolo et al. . | |
| 4,745,260 | 5/1988 | Albinger, Jr. et al. . | |
| 4,803,342 | 2/1989 | Steers et al. . | |
| 4,833,297 | 5/1989 | Del Fresno . | |
| 5,039,843 | 8/1991 | Muller . | |
| 5,120,934 | 6/1992 | Nakada et al. . | |
| 5,160,831 | 11/1992 | Thaler et al. . | |
| 5,233,914 | 8/1993 | English . | |
| 5,345,060 | 9/1994 | Hazan et al. . | |
| 5,349,160 | 9/1994 | Hazan et al. . | |
| 5,380,983 | 1/1995 | Cavada et al. . | |
| 5,391,859 | 2/1995 | Hazan et al. . | |
| 5,463,205 | 10/1995 | Sham et al. . | |
| 5,493,089 | 2/1996 | Chasen et al. . | |
| 5,637,931 | 6/1997 | Hsu | 219/245 |

FOREIGN PATENT DOCUMENTS

| | | | |
|---|---|---|---|
| 523794 | 1/1993 | European Pat. Off. . | |
| 2806808 | 8/1979 | Germany | 219/250 |
| 3702361 | 7/1987 | Germany . | |
| 59-189900 | 10/1984 | Japan | 219/250 |
| 61-58699 | 3/1986 | Japan . | |
| 61-280896 | 12/1986 | Japan . | |
| 63-206298 | 8/1988 | Japan . | |
| 1-107800 | 4/1989 | Japan . | |
| 1-190400 | 7/1989 | Japan . | |
| 3-21300 | 1/1991 | Japan . | |
| 4-114699 | 4/1992 | Japan . | |
| 4-183498 | 6/1992 | Japan . | |
| 1733542 | 5/1992 | U.S.S.R. . | |

*Primary Examiner*—John A. Jeffery

*Attorney, Agent, or Firm*—Dickstein Shapiro Morin & Oshinsky LLP

[57] ABSTRACT

A clothes iron comprises an automatic shut off system that is controlled by multiple switches. A first switch located on the iron's handle is closed when the iron is held by a user. A second switch located on the iron's heel is closed when the iron stands in the upright position. The switch on the handle prevents the automatic shut off from functioning when the iron is in use. The switch on the heel determines which of two fixed timing periods are used.

20 Claims, 5 Drawing Sheets

CLOTHES IRON WITH AUTOMATIC SHUT OFF SYSTEM CONTROLLED BY MULTIPLE SWITCHES

BACKGROUND

The present invention relates to an automatic shut off for a clothes iron and more particularly to an automatic shut off having multiple switches. One switch prevents the automatic shut off timer from running while another switch controls the timing period of the automatic shut off.

Clothes irons contain heated sole plates that are pressed against fabric to remove wrinkles. Such an iron generally has a handle that a user holds when operating the iron. The iron may also have a heel on which the iron can rest when not in use. The heel allows the iron to sit in a position where the heated sole plate is not in contact with the fabric or ironing board.

To be effective, the sole plate on an iron must be very hot. Thus there is a danger that an unattended iron will seriously burn the fabric or ironing board, or even ignite a fire. This danger is greatest when a user inadvertently leaves an iron and forgets to turn it off.

To reduce this risk, some irons have automatic shut offs. The automatic shut offs turn off power to the sole plate heater when the iron has not been used for a fixed period of time.

Some automatic shut offs use two separate timing periods to determine when power should be removed from the sole plate heater. A first timing period is selected because an iron is often left in a resting position on its heel while it is in use but the user is attending to related taskes, such as folding or hanging clothes. During normal use, it may be left in this position a relatively long period of time, perhaps 10 or 15 minutes. Thus, it is desirable to have the automatic shut off's timing period at least this long.

Once the iron is hot and the sole plate is in contact with fabric or the ironing board, however, such a timing period would not prevent serious damage if the iron is left unattended. Thus, a second, shorter timing period is required.

Various schemes have been devised to determine when the iron is "in use" and which of the two timing periods are appropriate. For example, some irons use motion sensors or accelerometers. When the iron is moved by the user, the motion sensor repeatedly resets the automatic shut off timer so that power will not be removed from the sole plate when the user is operating the iron. A disadvantage of this type of iron is that it automatically turns off when held motionless by the user. Such an iron also may not function properly on an unlevel surface. Also, chemicals harmful to the environment, such as mercury, are used in many motion sensors.

Proximity sensors are also used to determine if an iron is being used. These types of sensors, which may sense the interruption of an electromagnetic field such as by the presence of the user's body, are far more expensive than mechanical switches and are generally much less reliable.

Finally, photosensors have been used to determine whether an iron is in use. A photosensor on the iron's handle can sense when a user's hand is preventing light from reaching the photosensor. A disadvantage of this type of iron is it might not work to shut off the iron in a dark or dimly lit room. The photosensor could also become obstructed, which would prevent the automatic shut off feature from working.

SUMMARY

The present invention alleviates to a great extent these disadvantages by providing an automatic shut off having multiple mechanical switches. This allows inexpensive and reliable switches to control multiple time-out periods. Such an automatic shut off will work in dark or dimly lit rooms, and will not remove heat from the sole plate when an iron is held motionless by a user.

In one aspect of the present invention, the clothes iron is provided with two switches. One switch activates and deactivates the timer and the other switch controls the timing period of the automatic shut off.

In another aspect of the present invention, the clothes iron is provided with two mechanical switches. The first switch is located on the iron's handle and the second switch is located on the iron's heel. The first switch is closed when the iron is held by a user. The second switch is closed when the iron stands in the upright position. These two switches control an automatic shut off having two fixed timing periods.

It is an object of the present invention to provide an improved clothes iron.

It is another object of the present invention to provide an improved clothes iron with an automatic shut off controlled by a switch to prevent the automatic shut off timer from running and another switch to control the timing period of the automatic shut off.

It is another object of the present invention to provide an improved clothes iron with an automatic shut off controlled by multiple mechanical switches.

It is another object of the present invention to provide an improved clothes iron with an automatic shut off having two fixed timing periods.

It is a further object of the present invention to provide a clothes iron with the foregoing advantages which uses mechanical switches allowing for increased reliability and simple construction.

Other objects and advantages of the present invention will be readily apparent from the following description and drawings which illustrate a preferred embodiment of the invention.

DETAILED DESCRIPTION OF A PREFERRED EMBODIMENT

Figure 1:
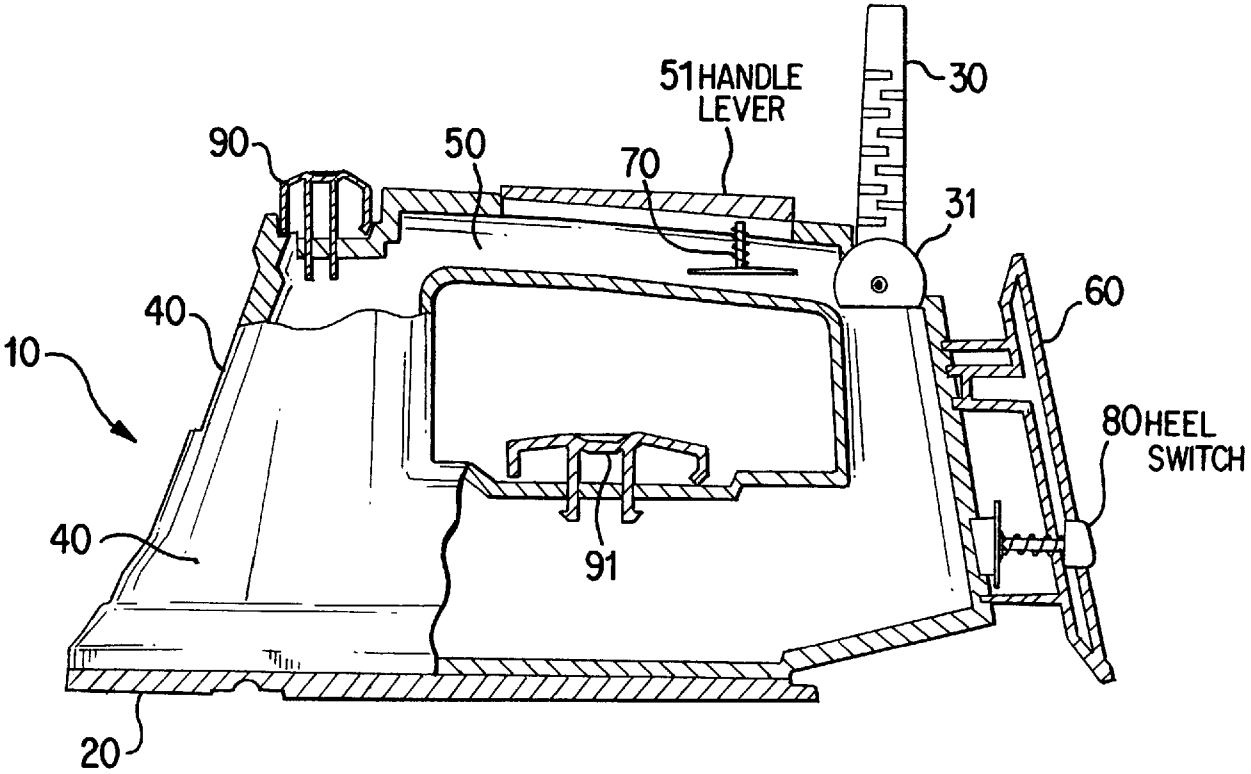
FIG. 1 is a partial cross sectional view of a preferred embodiment of the present invention taken along section line I—I of FIG. 2.

Refer to FIG. 1, which shows a clothes iron, generally designated by reference numeral 10, according to a preferred embodiment of the present invention. The iron 10 has a body 40 on the bottom of which is a sole plate 20. The iron receives electric power through an electrical cord 30 connected to the iron through a cord pivot 31. The iron 10 can be turned on and adjusted for a particular fabric through temperature and steam controls 90, 91. Conventional iron steam and heating mechanisms are included but not shown in the figures. The sole plate 20 is heated so that it can be pressed against fabric to remove wrinkles.

The user grips the iron 10 by its handle 50 to press the sole plate 20 onto the fabric and move the iron 10 across the fabric's surface. A handle lever 51 extends along the length of the handle 50. The end of the handle lever 51 near the front of the iron 10 is pivotally mounted to the handle 50. A handle switch 70 is in contact with handle lever 51 towards the back of the iron 10. The handle 50, handle lever 51 and handle switch 70 are configured such that the handle switch 70 is closed when a user grips the iron 10 by the handle 50.

The iron 10 also has a heel stand 60 located at the back of the body 40. A heel switch 80 is also located at the back of the body 40. The heel switch 80 extends away from the iron's body 40 and protrudes past the heel stand 60. The heel stand 60 and heel switch 80 are configured so that heel switch 80 is closed when the iron 10 rests on the heel 60 stand in an upright position.

Figure 2:
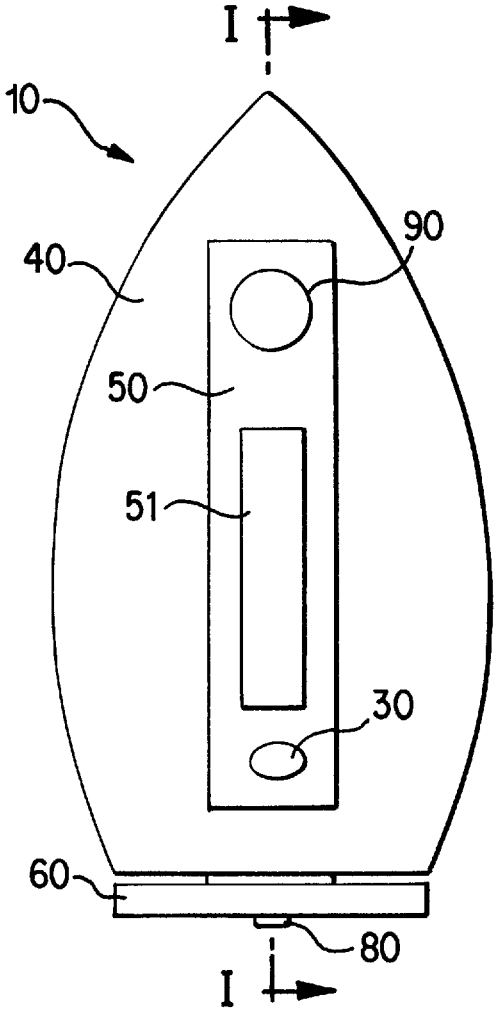
FIG. 2 is a top view of the iron shown in FIG. 1.

FIG. 2 is a top view of the iron 10 shown in FIG. 1. It can be seen in FIG. 2 that the handle lever 51 extends along a major portion of the handle 50 and that the handle lever 51 and heel switch 80 are located along the center line of the iron 10, along which the section for FIG. 1 is taken.

Figure 3:
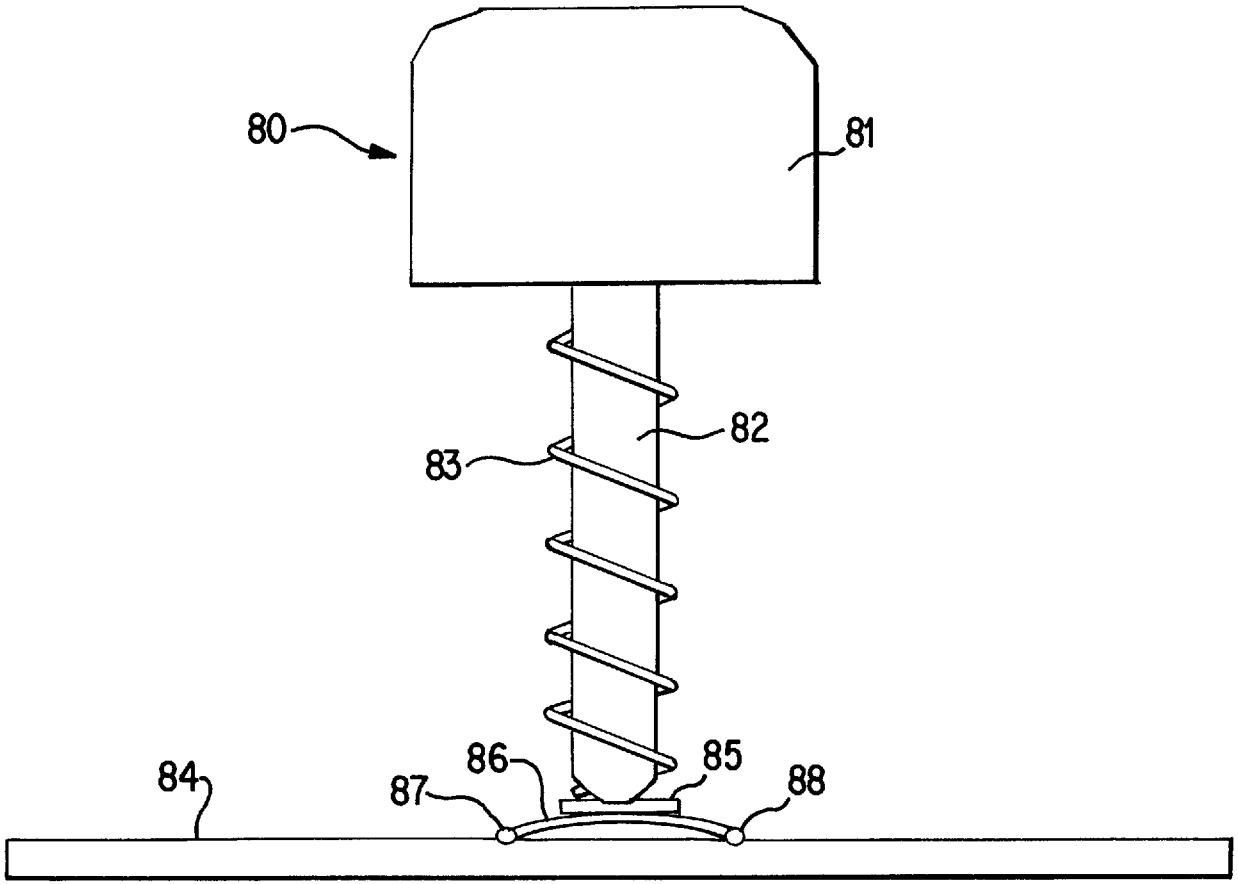
FIG. 3 is a side schematic view of the mechanical heel switch shown in FIG. 1.

FIG. 3 is a side schematic view of the mechanical heel switch 80 shown in FIG. 1. The heel switch has a switch actuator 81 that extends past the heel stand 60. The switch actuator 81 is connected to a post 82 around which a spring 83 is wound. One end of the spring 83 is in contact with the switch actuator 81 and the other end of the spring 83 is in contact with a pressing member 85 located at the opposite end of the post 82. The pressing member 85 is in contact with a spring plate 86 having connectors 87, 88 at opposite ends. The connectors 87, 88 are mounted on a printed circuit board 84. The printed circuit board 84, connectors 87, 88 and spring plate 86 are configured such that spring plate 86 is not in contact with the printed 84 circuit board 84 and the electric circuit in switch 80 is not completed. When the switch actuator 81 is pushed down, the pressing member 85 forces the spring plate 86 onto the printed circuit board 84 closing the electric circuit in switch 80.

Figure 4:
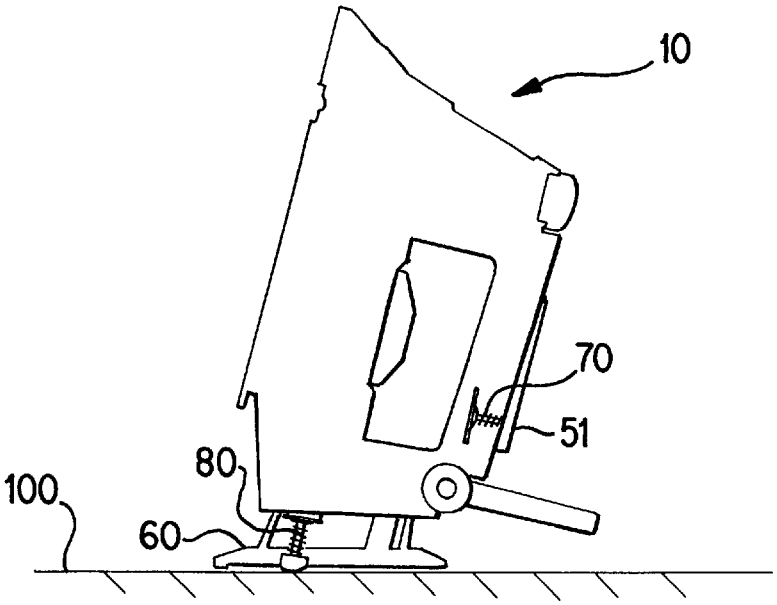
FIG. 4 is a side view of the iron of FIG. 1, showing the iron resting on its heel in the upright position.

FIG. 4 is a side view of the iron 10 resting on its heel 60 in the upright position. As can be seen in FIG. 4, the surface 100 on which the iron 10 rests causes the heel switch 80 to be closed. The handle switch 70 is not closed when the iron 10 is resting on its heel in the upright position.

Figure 5:
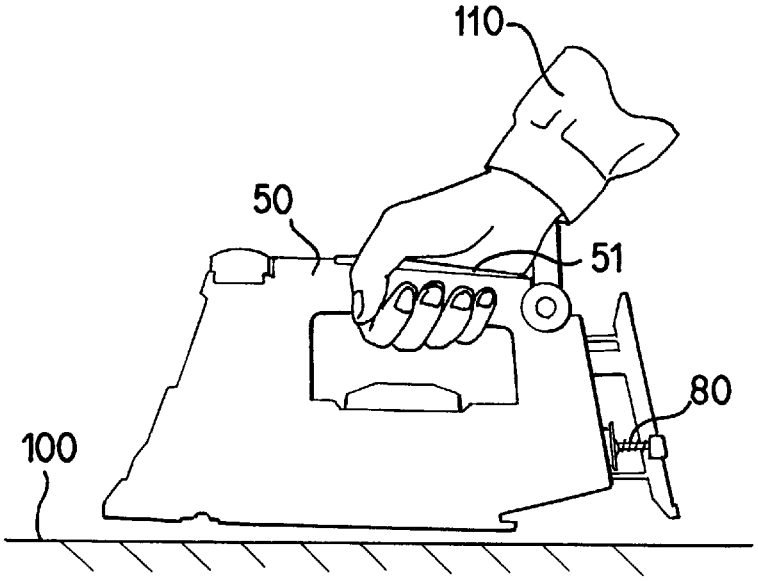
FIG. 5 is a side view of the iron of FIG. 1, showing the iron being held by the operator.

FIG. 5 is a side view of the iron 10 being held by an operator 110. As can be seen in FIG. 5, the operator's hand presses the handle lever 51 as they grip the handle 50. This causes handle switch 70 to be closed. The heel switch 80 is not closed when the iron 10 is held by the user 110 in this position.

Figure 6:
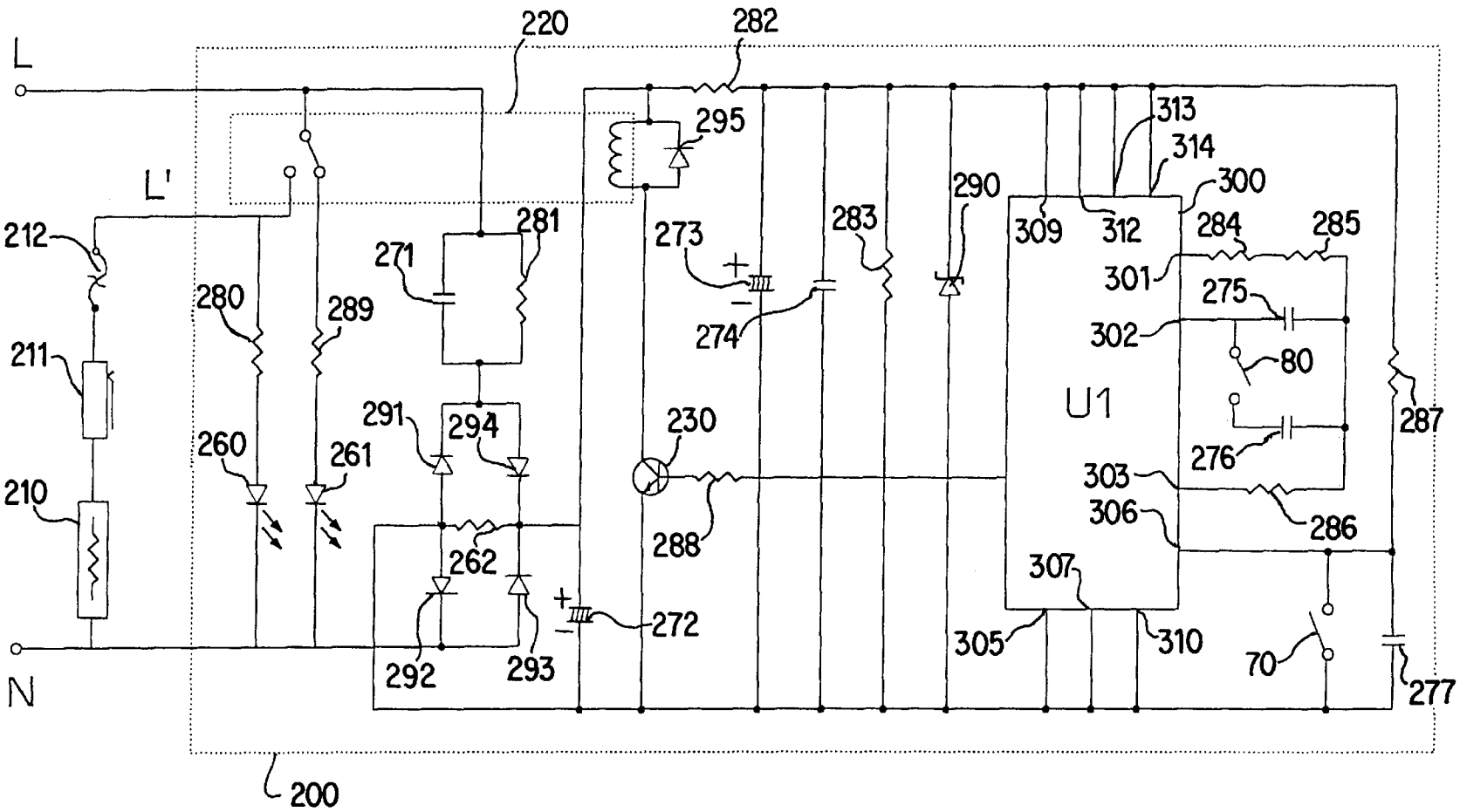
FIG. 6 is a diagram of a preferred embodiment of the circuitry associated with the automatic shut off feature.

FIG. 6 is a diagram of a preferred embodiment of the circuitry associated with the automatic shut off. Power is supplied to the automatic shut off control circuit 200 through the line and neutral inputs L and N. The automatic shut off control circuit 200 outputs power L', as described in detail below, to a 120 V AC, 1100 W heater 210, a 125 V AC, 13.75 A thermostat 211 and a 277 V AC, 15A microtemp fuse 212 arranged in series. The heater 210 heats the iron's sole plate 20.

The input L to the automatic shut off control circuit is connected to a 100 KΩ, ¼ W carbon film resistor 281 and a 1 μfd, 250 V mylar capacitor 271 arranged in parallel. The ends of the resistor 281 and capacitor 271 that are not connected to input L are connected to a rectifier bridge containing four 400 V, 1 A diodes 291–294 and a 18 KΩ, 0.5 W carbon film resistor 262. The rectified bridge creates a ground at the connection between diode 291 and diode 292 and a positive DC potential at the connection between diode 293 and diode 294. This positive DC potential is connected to ground through a 10 μfd, 100 V e. cap capacitor 272. The positive DC potential is also connected to a 1.5 KΩ, 2 W metal oxided resistor 282 providing a 10 V DC potential at the other end.

A 470 μfd, 16 V e. cap capacitor 273, 0.1 μfd, 25 V ceramic capacitor 274, 3 KΩ, 0.25 W carbon film resistor 283, and diode 10 V, 0.5 W zener diode 290 are connected in parallel between ground and the 10 V DC potential.

Ground is supplied to the GND input 307 of a programmable timer integrated circuit 300, in this embodiment a Motorola MC14541B. The auto-reset 305 and mode 310 inputs of the timer 300 are also tied to ground. The 10 V DC potential is supplied to the Vcc input 314 of the timer 300 to energize the integrated circuit. The Q/Q' select 309, A modulo divider 313, and B modulo divider 312 of the timer 300 are also tied to the 10 V DC potential.

An 82 KΩ, 0.25 W carbon film resistor 284 and a 750 KΩ, 0.25 W resistor 285 connected in series are tied to the RTC input 301 of the timer 300. The end of resistors 284, 285 not connected to the timer 300 is tied to a 0.001 μfd, 50 V ceramic capacitor 275, the other end of which is connected to the CTC input 302 of the timer 300. The end of capacitor 275 not connected to the timer 300 is tied to a 3 MΩ, 0.25 W resistor 286, the other end of which is tied to the master reset input 303 of the programmable timer. A 0.018 μfd, 100 V mylar capacitor 276 in series with the heel switch 80 are connected in parallel with capacitor 275.

Finally, the master reset 306 of timer 300 is connected to the 10 V DC potential through a 10 KΩ, 0.25 W carbon film resistor 287. The master reset 306 is also connected to ground through the handle switch 70 and a 0.01 μfd, 50 V ceramic capacitor 277 arranged in parallel.

By this arrangement the master reset 306 of the timer 300 will always be tied to ground when the handle switch 70 is closed. This prevents the timer 300 from counting so that the timer 300 always outputs a "1" from the Q output 308. Thus, in the present embodiment the timer 300 is prevented from counting when the user is gripping the iron's handle 50.

The timer's counting frequency is controlled through the RTC input 301 and the CTC input 302 by the heel switch 80. When the heel switch 80 is open, the timer 300 will output a "0" from t he Q output 308 after about 60 seconds. When the heel switch 80 is closed, the timer 300 will output a "0" from the Q output 308 after about 20 minutes. Thus, in the present embodiment a timing period of about 20 minutes is selected when the iron rests on its heel stand 60, and a timing period of about 60 seconds is selected when the iron is not resting on its heel stand 60.

The Q output 308 is connected to the base of an NPN transistor 230 through a 10 KΩ, 0.25 W carbon film resistor 288. When Q output 308 is high (a "1"), current can flow through the emitter and collector of transistor 230. When Q output 308 is low (a "0"), current is prevented from flowing through the emitter and collector of transistor 230. The emitter of transistor 230 is tied to ground and the collector is attached to a 125 VAC, 15 A coil, 48 V DC relay 220. A 75 V, 0.2 A diode 295 is connected in parallel to the relay 220. The end of the relay 220 not connected to the transistor 230 is connected to the positive DC potential output of the rectifier bridge.

Thus, when the programmable timer 300 completes its timing count and generates a "0" as its Q output 308, current cannot flow through the transistor 230 and the coil in the relay 220 is de-engergized.

A green 3 mm LED 261 in series with a 30 KΩ, 1 W metal oxided resistor 289 is connected between ground and the normally closed terminal of the relay 220. A red 3 mm LED 260 in series with a 30 KΩ, 1 W metal oxided resistor 280 is connected between ground and the normally open terminal of the relay 220. The normally open terminal of relay 220 is also the L' output of the automatic control circuit 200. Thus, when the timer 300 has completed its count, the coil in the relay 220 is not energized, causing the green LED 261 to be illuminated and power is not supplied to the normally open connection of L'. Thus, power is not supplied to the heater. When the timer 300 has not completed its count, the coil in the relay 220 is energized, causing the red LED 260 to be illuminated and allowing L' to supply power to the heater 210.

Although a preferred embodiment is specifically illustrated and described herein, it will be appreciated that modifications and variations of the present invention are covered by the above teachings and within the purview of the appended claims without departing from the spirit and intended scope of the invention.

What is claimed as new and desired to be secured by Letters Patent of the United States is:

1. An iron comprising:

(a) a sole plate defining the bottom surface of the iron, (b) a heater mounted in the iron to heat the sole plate, (c) a handle at the top of the iron sized to be gripped during use, (d) a heel stand at the back of the iron to support the iron in an upright resting position, (e) a timer electrically coupled to a heater switch for removing power from the heater after one of a plurality of timing periods including a short timing period and a long timing period, (f) a first switch for turning on said timer, and (g) a second switch for selecting from among the plurality of timing periods.

2. An iron according to claim 1 wherein the first switch is located on the handle such that the first switch changes state when the handle is gripped during use.

3. An iron according claim 1 wherein the second switch is located on the heel stand such that the second switch changes state when the iron is in the upright resting position.

4. An iron according to claim 3 wherein the short timing period is selected when the iron is not resting in the upright position and the long timing period is selected when the iron rests in the upright position.

5. An iron according to claim 4 wherein the short timing period is about 60 seconds.

6. An iron according to claim 4 wherein the long timing period is about 20 minutes.

7. An iron according to claim 1 wherein the heater switch includes a relay.

8. An iron according to claim 7 further including a transistor coupled to the timer and the relay, the transistor preventing current from flowing through the relay in response to a first signal from the timer.

9. An iron comprising:

(a) a sole plate defining the bottom surface of the iron, (b) a heater mounted in the iron to heat the sole plate, (c) a handle at the top of the iron sized to be gripped during use, (d) a heel stand at the back of the iron to support the iron in an upright resting position, (e) a mechanical handle switch located on the handle, the handle switch having at least a first handle switch state and a second handle switch state, (f) a mechanical heel switch located at the heel stand, the heel switch having at least a first heel switch state and a second heel switch state, and (g) an electronic timer electrically coupled to a heater switch for removing power from the heater after a first period of time or a second period of time based on the handle switch state and heel switch state.

10. An iron according to claim 9 wherein the heel switch is in the first heel switch state when the iron is not in the upright position and the heel switch is in the second heel switch state when the iron is in the upright resting position.

11. An iron according to claim 10 wherein the mechanical heel switch comprises:

(a) a switch activator;

(b) a post connected to the switch activator;

(c) a spring wound around the post;

(d) a spring plate in communication with the post; and (e) a printed circuit board connected to said spring plate such that the mechanical heel switch is open when the switch activator is not pressed toward the printed circuit board and the mechanical heel switch is closed when the switch activator is pressed toward the printed circuit board.

12. An iron according to claim 9 wherein the handle switch is in the first handle switch state when a user is not gripping the handle and the handle switch is in the second handle switch state when the user grips the handle.

13. An iron according to claim 12 wherein the handle switch is in contact with a handle lever extending along a major portion of the handle.

14. An iron according to claim 9 wherein the first period of time begins when the heel switch is in the second heel switch state and the handle switch transitions to the first handle switch state and the second period of time begins when the heel switch is in the first heel switch state and the handle switch transitions to the first handle switch state.

15. An iron according to claim 14 wherein the first period of time is about 20 minutes and the second period of time is about 60 seconds.

16. An iron according to claim 9 wherein the heater switch includes a relay and a transistor coupled to the timer and the relay.

17. An iron according to claim 16 wherein the timer performs a timing count and the transistor allows current to flow through the relay while the timer performs the timing count.

18. An iron according to claim 17 wherein the transistor prevents current from flowing through the relay in response to a signal from the timer at completion of the timing count.

19. An iron according to 16 wherein the relay is energized when the handle switch is in the second handle switch state.

20. An iron according to 16 wherein the relay is deenergized when the handle switch is in the first handle switch state and the timer has completed a timing count.

* * * * *